United States Patent [19]

Bowley et al.

[11] Patent Number: 4,968,856

[45] Date of Patent: Nov. 6, 1990

[54] SOCKET COVER

[76] Inventors: George P. Bowley, 7011 Silverview Rd., N.W.; Robert K. Sullivan, 12 Strathclaire Place, S.W., both of Calgary Albert, Canada

[21] Appl. No.: 351,606

[22] Filed: May 12, 1989

[30] Foreign Application Priority Data

Dec. 30, 1988 [CA] Canada ..... 587328

[51] Int. Cl.[5] ..... H01R 13/447

[52] U.S. Cl. ..... 174/67; 439/136

[58] Field of Search ..... 174/67; 220/242; 439/135, 136

[56] References Cited

U.S. PATENT DOCUMENTS 2,988,242 6/1961 Kneip ..... 174/67 X

*Primary Examiner*—Leo P. Picard

*Assistant Examiner*—David A. Tone

*Attorney, Agent, or Firm*—Lerner, David, Littenberg, Krumholz & Mentlik

[57] ABSTRACT

There is described an improved safety cover for an electrical outlet comprising a slidable cover for partially or completely covering the electrical outlet, a housing defining therein a track to guide the cover for sliding movement over the electrical outlet and a connector for securing the housing to the electrical outlet itself.

9 Claims, 3 Drawing Sheets

SOCKET COVER

FIELD OF THE INVENTION

The present invention relates to a safety device and more particularly to an electrical outlet cover for residential and commercial buildings wherein one or more slidable covers are provided to cover the electrical socket when not in use. By covering the electrical outlet, the invention provides greater child safety and improved aesthetic appearance for the outlet.

BACKGROUND OF THE INVENTION

The need for an electrical outlet cover for child safety has long been realized. There exists today a safety plug, which is a non-conductive plastic plug which once placed into the wall socket is difficult to remove so that the outlet is unavailable for a child to insert a finger or a conductive object, such as a key, into one of the socket slots. The safety plug is also somewhat difficult for the adult to remove and requires storage when the socket is in use. The safety plug also does not improve the aesthetic attractiveness of the electrical outlet.

Although products have been developed to improve the appearance of light switches, phone jacks and built-in vacuum outlets, electrical outlets still remain an unattractive sight in any wall.

SUMMARY OF THE INVENTION

Accordingly, it is an object of the present invention to provide an electrical outlet cover which obviates and mitigates from the disadvantages of the prior art.

It is a further object of the present invention to provide a safety cover which can be easily and conveniently substituted for existing conventional outlet covers.

The present invention provides a means for covering electrical wall outlets so that they are child resistant and more aesthetically attractive. The invention makes the electrical outlet childproof or more specifically less dangerous to children, firstly in that the electrical outlet is covered and therefore not visible to the child so as not to be an attractive play thing, and secondly in that the slidable cover can be made difficult to open with or without a locking means. The aesthetic attractiveness of the wall outlet is improved by the present invention in that the holes and appearance of the electrical wall outlet are covered by the slidable cover, and in that the general appearance of the present invention can be made smooth and relatively unobtrusive (with a projection from the wall of approximately 1 cm) and colour matched with the decor of the room. A further advantage of the present invention can be that the slidable cover member slides within the confines of the cover housing, such that there is no lid or flap projecting away from the outlet cover when the outlet is in use.

According to the present invention, therefore, there is provided a safety cover for an electrical outlet comprising slidable cover means for partially or completely covering the electrical outlet, housing means defining therein means to guide the cover means for sliding movement over the electrical outlet, and means for securing the housing means to the electrical outlet.

BRIEF DESCRIPTION OF THE DRAWINGS

Preferred embodiments of the present invention will now be described in greater detail with reference to the drawings, wherein.

DETAILED DESCRIPTION

Figure 1:
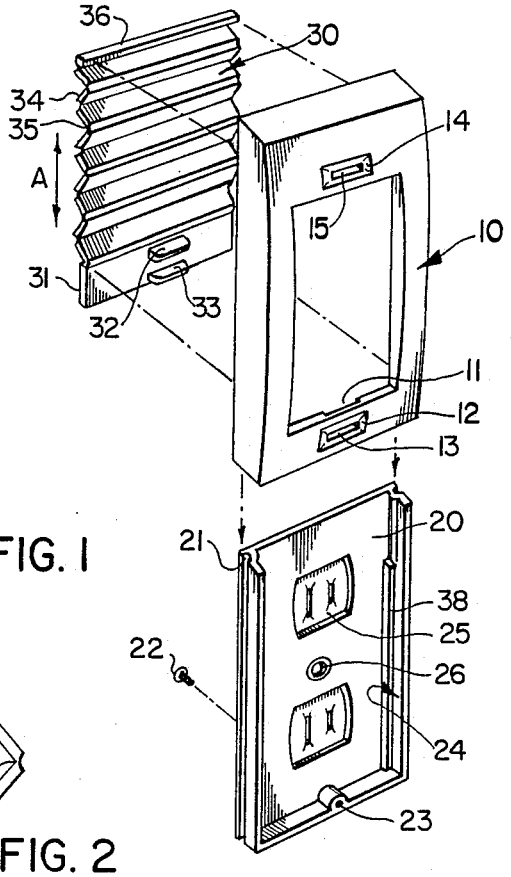
FIG. 1 is a perspective exploded view of the three main components of the present outlet cover.
Figure 2:
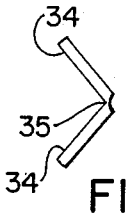
FIG. 2 is a side elevational view showing two adjoining segments of the collapsible slidable cover member.

As shown in FIG. 1, the present outlet cover consists of three primary components, namely, a surrounding frame member on facia 10, a back plate 20 which, when connected to facia 10, forms a housing, and a collapsible slidable cover 30. Collapsible cover 30 comprises a plurality of segments 34 connected to one another along hinge lines 35, a flexibly resilient bottom portion 31 and a top segment 36. The collapsing function of the cover operates much like a folding blind or accordion, such that as shown in FIG. 2, the segments 34 fold in towards one another about hinge 35. Using a highly resilient plastic thinned along hinge lines 35, it is possible to mold the cover 30 in one piece. Bottom segment 31 is provided with two tabs, namely, lift tab 32 and lock button 33. The cover 30 moves in the direction indicated by the arrows A along guide means such as a track 24 defined, for example, between a bead 38 and the opposed inner surface of facia 10. The lock button 33 locks into looking hole 13 provided within a recess 12 in the outer surface of the facia. A small ramp-like recess 11 is provided to guide the lock button 33 into the hole 13. When lock button 33 is depressed, causing an inward bending of segment 31, the bottom is released from frame member 10 and the slidable cover 30 may be lifted using lift tab 32. An equivalent lock button recess 14 and lock hole 15 are provided at the top of frame member 10 to engage tab 32 when cover 10 is in the fully opened position.

Frame member 10 slides over back plate 20 guided by grooves 21 and is connected to back plate 20 by fixing screw 22, which screws into frame member 10 through the hole 23. Back plate member 20 may then be fixed to an outlet 25 with a screw (not shown) through hole 26 as seen most clearly from FIG. 5.

Figure 3:
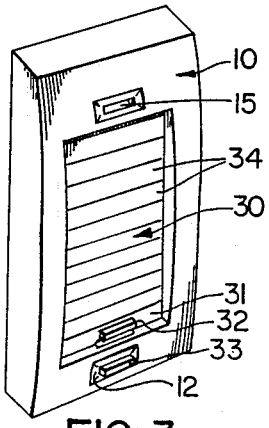
FIG. 3 is a perspective view of the cover showing the slidable cover in a closed position.

FIG. 3 is a perspective view of the present cover wherein slidable cover 30 is in the closed position. As shown, lock button 33 is engaged to lock cover 30 in the closed position. By pressing against button 33 into recess 12 with one finger, cover 30 may be opened by lifting lift tab 32. Track 24 (FIG. 1) may be of substantially the same thickness as cover 30 such that the cover 30 is always in a flat state in the portion visible, that is, covering the outlet, such that the collapsing and folded storage of slidable cover 30 occurs in the upper portion of the frame member 10 above locking hole 15 and above the upper ends of beads 38.

Figure 4:
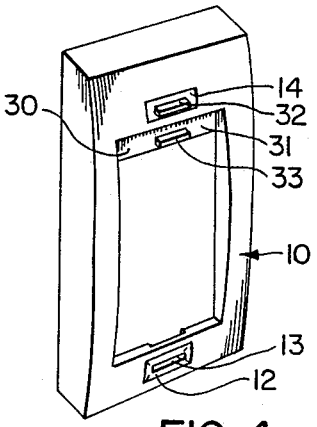
FIG. 4 is a perspective view of the cover showing the slidable cover member in the fully opened position.

FIG. 4 shows slidable cover 30 locked in the fully opened position. Note that lift tab 32 now acts as the lock button and the lock button 33 is now acting as the lift tab. Although not shown in the figures, the lock configuration of the upper lock mechanism is equivalent to the bottom lock mechanism, i.e. a lock button guide ramp 11 is similarly disposed at the top of the frame member 10.

Figure 5:
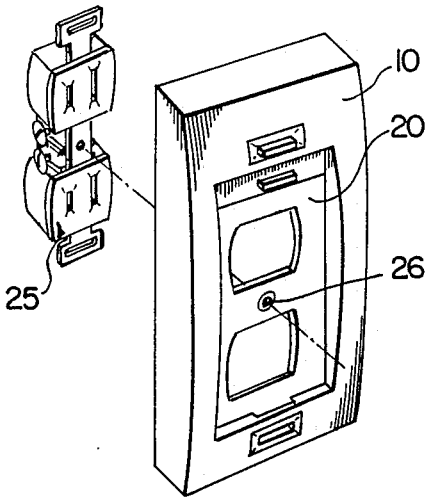
FIG. 5 is a perspective view of the present cover in a position to be installed over an electrical wall outlet.

FIG. 5 shows a wall outlet 25 and the frame member 10 with back plate 20 attached. In this view, the slidable cover is omitted for clarity. As can be seen, the frame member, attached to the back plate, covers the wall outlet and is fixed to the outlet by a screw (not shown) through hole 26.

The operation of the device of the invention is simple. The slidable cover is kept closed at all times when the outlets are not in use. With the slidable cover closed, the cover unit has a sleek, uniform and solid appearance, which when given a suitable colour will blend evenly with any decor. When an appliance is to be used, release button 33 is pressed into recess 12 and the cover is lifted by the lift tab 32. When slidable cover 30 is lifted, foldable segments 34 begin collapsing in the space provided in the upper part of the frame member 10. Slidable cover 30 may be partially lifted when only one of the two outlets is needed, or may be lifted until lift tab 32 locks into the locking hole 15 of the upper lock mechanism. In this position both of the electrical outlets may be used. The invention offers a wall outlet cover which is not much larger in wall area than a standard outlet cover plate and protrudes from the wall by approximately 1 cm. The cover also protects the electrically live outlet openings from small children, and the combined action of pressing the lock button and lifting the lift tab in order to open the slidable cover ensures a further degree of child safety.

Although the invention is described above by means of the example shown in the drawings, the invention is not limited to the illustrated embodiment. Accordingly, it is possible that the cover unit use a slidable cover which is not of the folding type. The locking means may also be different, such that the slidable cover may be lockable in the middle position such that only one of the electrical outlets is exposed. The lock button of the locking means may also desirably be positioned on the sides of the unit for aesthetic purposes, and it may also be desirable to require that two lock buttons be pushed simultaneously for the cover to be opened. It is also possible to provide a back plate which is designed to cover a combined electrical outlet and switch box or an outlet where more than two sockets are provided. It is also possible for more than one cover to be provided, such that one cover covers the upper outlet receptacle and retracts into the upper part of the frame member and a second cover covers the lower outlet receptacle and retracts into the lower portion of the frame member. Also using somewhat heftier construction, the outlet cover unit can also be used to cover outdoor electrical outlets to keep them safe from children, the elements, including precipitation and insects.

One such alternative embodiment will now be described with reference to FIGS. 6 to 9 showing a somewhat simplified embodiment compared to that described above.

Figure 8:
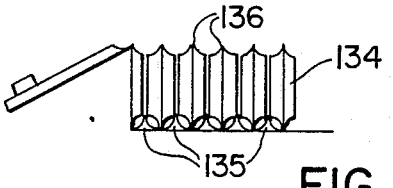
FIG. 8 is a side elevational view of the collapsible slidable cover shown in FIG. 6 in a folded condition.

Once again, the cover consists of three primary components, namely a facia 100, a back plate 120 which forms a housing when connected in combination with facia 100 and a collapsible slidable cover or shutter 130 sandwiched between the facia and the back plate for slidable up and down movement as will be described below. Shutter 130 comprises a plurality of relatively wide segments 134 and thinner peaked segments 135 connected together along hinge lines 136 so that in its folded or collapsed condition, the segments fold into one another as shown in FIG. 8. Once again, it is possible to form cover 130 in one piece to have the illustrated construction. Cover 130 further includes a pair of spaced-apart forwardly protruding tabs connected thereto consisting of a lift tab 132 and a locking tab 133.

Figure 6:
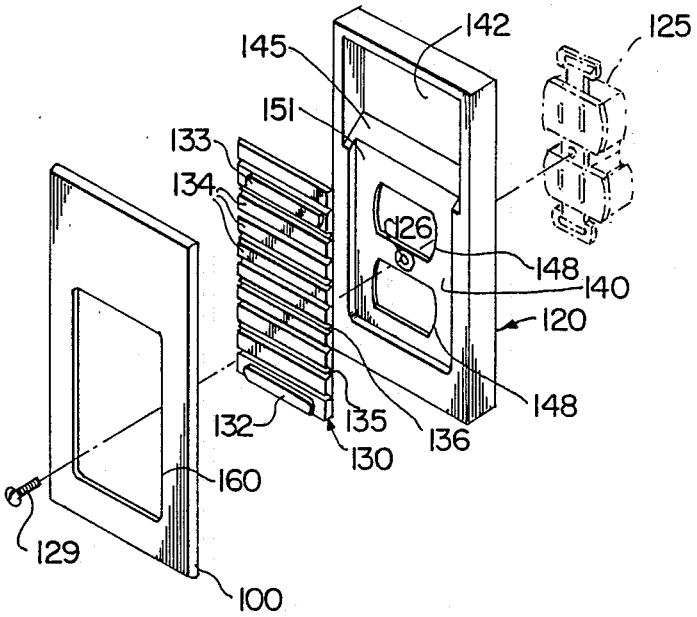
FIG. 6 is a front perspective exploded view of the three main components of another embodiment of the present outlet cover.

Back plate 120, as seen most clearly in FIG. 6, is or may be substantially rectangular in shape including a first centrally located substantially rectangular recess 140 and a second rectangular recess 142 of relatively greater depth formed adjacent one of the ends of the back plate. The two recesses merge into one another via an inclined ramp 145 therebetween.

The inner surface 151 of recess 140 includes a pair of apertures 148 to receive the sockets of an AC outlet 125 connected thereto by means of a screw 129 passing through hole 126. The outlet will of course be installed in a wall or similar surface, and screw 129 therefore connects the present cover to the same wall or surface.

Figure 7:
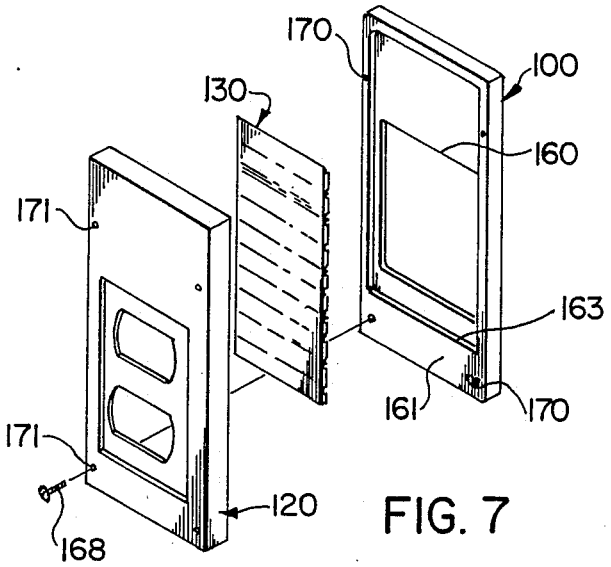
FIG. 7 is a rear perspective exploded view of the outlet cover of FIG. 6.

With reference to FIGS. 6 and 7, facia 100 is formed having a substantially rectangular aperture 160 therethrough exposing apertures 148 and the outlets therein when shutter 130 is in its fully opened position. Facia 100 further includes in rear surface 161 thereof a substantially rectangular recess 163, the width and depth of which substantially equals the width and thickness of shutter 130. Back plate 120 and facia 100 are connected together by means of, for example, threaded fasteners 168 which screw into threaded holes 170 in rear surface 161 through holes 171 in back plate 120. When thus connected, recess 163 defines in cooperation with back plate 120 a track along which shutter 130 is free to slide in an up and down movement, with ramp 145 facilitating movement of the shutter into a folded storage position within recess 142 to thereby expose the electrical outlets. Insofar as recess 163 is substantially equal to the thickness of the shutter, the shutter is maintained in an aesthetically pleasing flattened condition in its visible portion.

Figure 9:
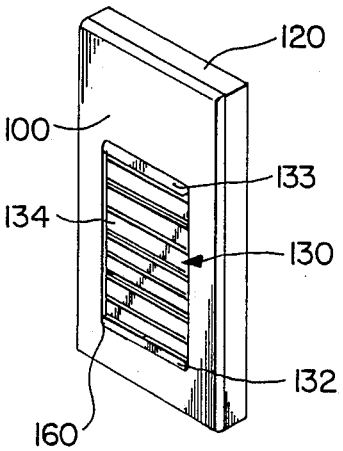
FIG. 9 is a front perspective view of the cover of FIG. 6 in an assembled condition showing the slidable cover in a fully closed position.

With reference to FIG. 9, the shutter is shown in a fully closed position with lift tab 132 located against the lower edge of aperture 160 of facia 100, and locking tab 133 abutting the upper edge of aperture 160. To open the shutter to expose the outlets, locking tab 133 is depressed to clear the upper edge of aperture 160 and the shutter is lifted by means of lift tab 132, whereupon segments 134 fold into storage recess 142. The coordinated operation of tabs 132 and 133 required to open the shutter makes the cover extremely difficult if not impossible to open by small children.

A further variation contemplated by the applicants but not illustrated is the use of a hinged door in place of a collapsible shutter to cover the electrical outlets, the hinged door employing a child resistant latch mechanism preventing ingress.

While the invention has been described in connection with the features as described herein, it will be apparent to those skilled in the art that various modifications can be made without departing from the spirit and essence of the present invention. It is to be understood therefore that the invention may be varied within the scope of the claims appended hereto.

We claim:

1. A safety cover for an electrical outlet comprising: slidable cover means for partially or completely covering said electrical outlet; housing means defining therein means to guide said cover means for sliding movement over said electrical outlet, said slidable cover means foldably collapsible for storage within said housing means; and means for securing said housing means to said electrical outlet.

2. The safety cover of claim 1 wherein said means to guide comprise a track formed on opposite inner sides of said housing for slidably receiving therein a respective lateral edge of said cover means.

3. The safety cover of claim 2, further comprising locking means for locking said cover means in a fixed closed position.

4. The safety cover of claim 3, wherein said locking means comprise one or more tab means on said cover means adapted to releasably engage said housing means.

5. The safety cover of claim 4, further including a lift-tab provided on said cover means to facilitate the opening and closing movement thereof.

6. The safety cover of claim 6, wherein said tab means includes a tab fixed to a resilient portion of said cover means and said housing means include a correspondingly shaped aperture located in said housing means to receive said tab therein such that pressing said tab to disengage said aperture allows said cover means to be moved.

7. the safety cover of claim 6, wherein said cover means are lockable in each of a fully closed and a fully opened position thereof.

8. The safety cover of claim 6, wherein two of said tabs are provided, one of said tabs acting as said lift-tab and the other said tab acting as a release button, such that the two said tabs provide lift-tab means and release button means for locking said cover means in either the fully opened or fully closed position thereof.

9. A safety cover according to claim 1, wherein said housing means comprises a back plate which replaces an existing electrical outlet cover plate and a facia releasably connected thereto.

* * * * *

UNITED STATES PATENT AND TRADEMARK OFFICE

CERTIFICATE OF CORRECTION

PATENT NO. : 4,968,856

DATED : November 6, 1990

INVENTOR(S) : George P. Bowley and Robert K. Sullivan

It is certified that error appears in the above-identified patent and that said Letters Patent is hereby corrected as shown below:

Column 2, line 47, "looking" should read --locking--.

Column 6, line 4, "claim 6" should read --claim 5--.

Signed and Sealed this

Seventh Day of April, 1992

*Attest:*

HARRY F. MANBECK, JR.

*Attesting Officer*

*Commissioner of Patents and Trademarks*